US007749081B1

(12) United States Patent
Acres

(10) Patent No.: US 7,749,081 B1
(45) Date of Patent: Jul. 6, 2010

(54) METHOD AND APPARATUS FOR DISPLAYING PLAYER TRACKING INFORMATION ON AN ELECTRONIC GAMING MACHINE DISPLAY

(75) Inventor: John F. Acres, Corvallis, OR (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 09/558,933

(22) Filed: Apr. 26, 2000

Related U.S. Application Data

(60) Provisional application No. 60/131,453, filed on Apr. 28, 1999.

(51) Int. Cl.
*A63F 9/24* (2006.01)

(52) U.S. Cl. ..... 463/31; 463/34; 463/40; 463/41; 463/42; 463/43

(58) Field of Classification Search ..... 463/30, 463/31, 25, 24, 29, 34, 40–43
See application file for complete search history.

(56) References Cited

U.S. PATENT DOCUMENTS

| | | | | |
|---|---|---|---|---|
| 3,659,284 | A | 4/1972 | Rusch | |
| 4,517,657 | A | 5/1985 | Carmean | |
| 5,547,197 | A | 8/1996 | Ishibashi | |
| 5,603,659 | A | 2/1997 | Okada | |
| 5,655,961 | A | 8/1997 | Acres et al. | |
| 5,761,647 | A | 6/1998 | Boushy | |
| 5,796,389 | A | 8/1998 | Bertram et al. | |
| 5,909,486 | A * | 6/1999 | Walker et al. | 379/114.11 |
| 5,971,271 | A * | 10/1999 | Wynn et al. | 235/380 |
| 6,110,041 | A * | 8/2000 | Walker et al. | 463/20 |
| 6,195,090 | B1 * | 2/2001 | Riggins, III | 725/139 |
| 6,241,524 | B1 * | 6/2001 | Aoshima et al. | 434/118 |
| 6,302,793 | B1 * | 10/2001 | Fertitta et al. | 463/25 |
| 6,371,852 | B1 * | 4/2002 | Acres | 463/25 |

FOREIGN PATENT DOCUMENTS

| | | | |
|---|---|---|---|
| EP | 0769769 | A1 * | 4/1997 |
| WO | 97/12315 | | 4/1997 |
| WO | 00/32286 | | 6/2000 |

* cited by examiner

*Primary Examiner*—Peter DungBa Vo
*Assistant Examiner*—Omkar Deodhar
(74) *Attorney, Agent, or Firm*—Weaver Austin Villeneuve & Sampson LLP

(57) ABSTRACT

A gaming machine includes gaming electronics for projecting a game image onto a gaming machine display associated with the gaming machine. The gaming machine is coupled over a network to a host computer that keeps track of data corresponding to a casino patron such as loyalty bonus information, player ID, and so forth ("player tracking data"). The player tracking data is transmitted from the host computer to a gaming machine responsive to identification of the casino patron operating the machine via an electronic card reader. The player tracking data is received by a machine communication interface within the gaming machine and further processed for display by a video overlay device that combines the game image with the player account display information. Accordingly, both the game (e.g. slot machine) and the player account information can appear on the same display monitor.

13 Claims, 4 Drawing Sheets

METHOD AND APPARATUS FOR DISPLAYING PLAYER TRACKING INFORMATION ON AN ELECTRONIC GAMING MACHINE DISPLAY

RELATED APPLICATION DATA

This application claims priority from provisional application, U.S. Ser. No. 60/131,453, titled ELECTRONIC GAMING MACHINE WITH LOYALTY BONUS DISPLAY, which was filed Apr. 28, 1999.

BACKGROUND OF THE INVENTION

This invention relates generally to electronic gaming machines and more particularly to such a machine having display electronics capable of displaying loyalty bonus information simultaneously with the game display.

Video gaming machines utilize a video screen to present game information. These screens are almost always in color and offer increasingly higher resolution and increasingly complex games. Players must concentrate on the game screen to keep track of game progress.

Modern casinos gain great benefit from establishing a bond of loyalty with their customers. Player tracking systems have evolved over the past 15 years to measure individual player activity and award "points" based upon the frequency of that activity. Player tracking systems generally include a means for the customer to identify himself (a magnetic stripe card). Each gaming machine is then equipped with a card reader to accept player cards and a display to let the player know that the card was properly accepted and the account status—generally as a point total. In recent years, systems have begun to provide additional bonuses to players in return for volume of play and loyalty. Bonuses include extra jackpots, free games and other awards. Advanced systems also allow players to convert points—which originally were redeemed for prizes, cash or services—into free play on the gaming machine.

Most player tracking systems use a small LCD (Liquid Crystal Display), LED (Light Emitting Diode display) or VFD (Vacuum Fluorescent Display) to inform the player of loyalty awards. The information presented on these displays has always been distinct from game specific information. As more and more awards are made for loyalty, it becomes harder and harder to communicate everything to players. Player tracking displays have grown in size and complexity. Since these displays must mount within or upon existing gaming machines, space is often limited which makes it impossible to install the larger displays that have recently become available. And because player-tracking systems are add-ons to game machines, and because of competitive and budgetary pressures, displays are further restricted by cost considerations. For example, no commercial player tracking system has ever offered a separate multi-color display since the cost and size for such a display are usually prohibitive.

Game complexity makes the problem even worse. Loyalty bonuses often require timely response from the player in order to be won. Since players concentrate more on complex game events, they are slower to notice loyalty awards on the player tracking display.

Accordingly, a need remains for a gaming machine display solution that overcomes the drawbacks of the prior art.

SUMMARY OF THE INVENTION

This patent outlines a solution by making use of the game video display to simultaneously present player tracking and loyalty award information. By strategically arranging the game features, most current video displays can easily present such information without interfering with game operation. Since the information is directly adjacent to the game display, it is much easier to see. Because the game display is virtually always capable of color display, the player tracking information is even more noticeable. Bonus information can even be presented with animated graphics. Costs are also lowered since there is only one display to purchase.

A gaming machine includes gaming electronics for projecting a game image onto a gaming machine display associated with the gaming machine. The gaming machine is coupled over a network to a host computer that keeps track of data corresponding to a casino patron such as loyalty bonus information, player ID, and so forth ("player tracking data"). The player tracking data is transmitted from the host computer to a gaming machine responsive to identification of the casino patron operating the machine via an electronic card reader. The player tracking data is received by a machine communication interface within the gaming machine and further processed for display by a video overlay device that combines the game image with the player account display information. Accordingly, both the game (e.g. slot machine) and the player account information can appear on the same display monitor.

In an alternate embodiment, an apparatus for displaying additional information on a gaming machine display comprises a host computer, a gamine machine and communication means. The host computer includes a database of player tracking information. The gaming machine is coupled to the host computer over a network and includes a gaming machine display and gaming electronics for generating and projecting a game image onto the gaming machine display. The apparatus includes communication means for bi-directional communication between the host computer and the gaming machine. Supplemental commands within the communication means are operative with the gaming electronics to combine the game image with a player tracking image generated from the player tracking information communicated from the host computer to the gaming machine.

The invention also includes methods for displaying player account information on a display of a gaming device connected by a network to a host computer. In a preferred method, a player account accessible by the host computer is created. Game display information is then generated to create an original image and the player account is accessed from the gaming device. An overlay image is created from generated player account display information. The original image is then combined with the overlay image to create a combined image the resulting combined image displayed on the display of the gaming device.

The foregoing and other objects, features and advantages of the invention will become more readily apparent from the following detailed description of a preferred embodiment of the invention that proceeds with reference to the accompanying drawings.

DETAILED DESCRIPTION

Figure 1:
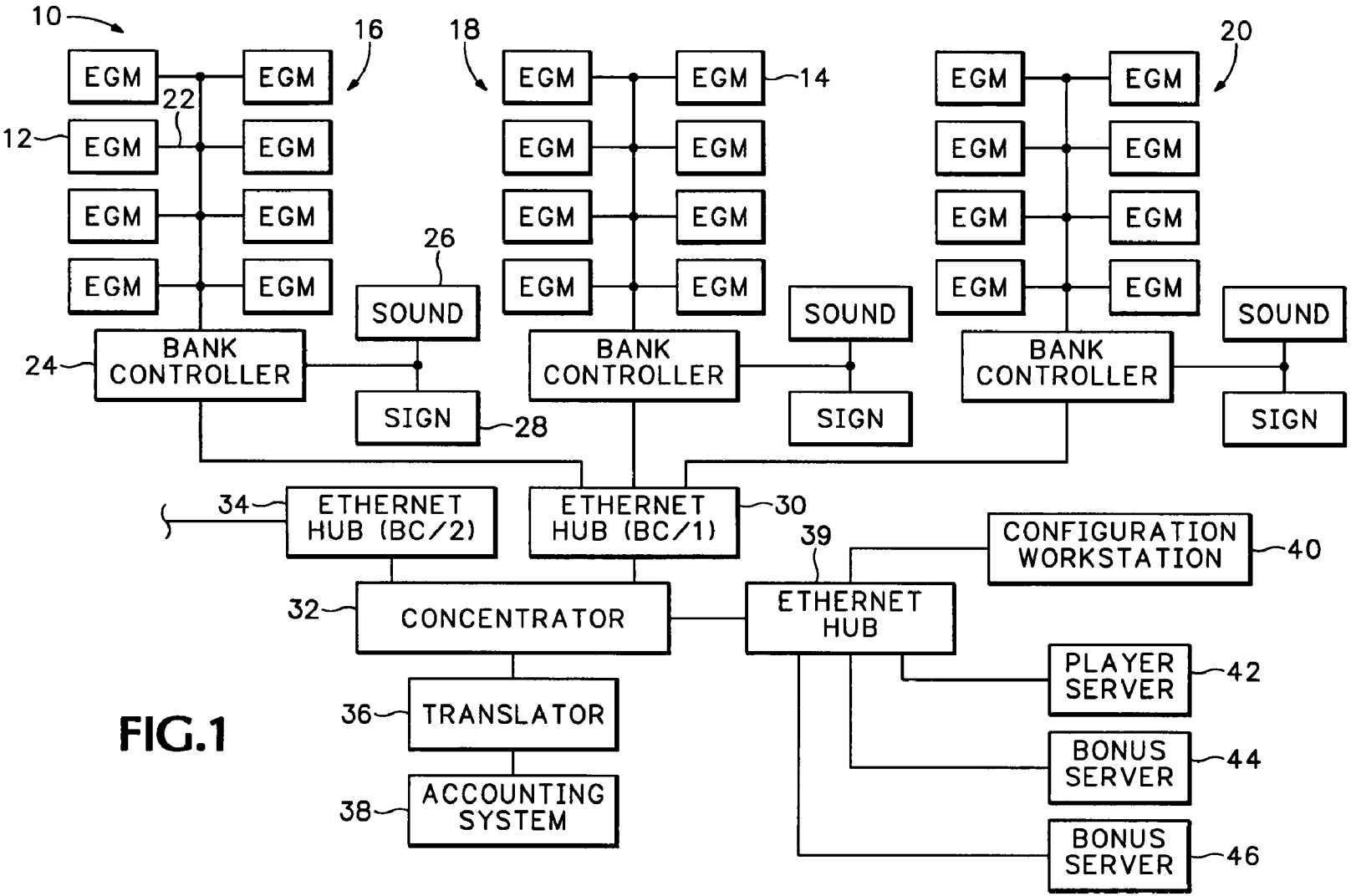
FIG. 1 is a schematic diagram of a plurality of electronic gaming machines interconnected by a computer network to a host computer in accordance with the present invention.

Turning now to FIG. 1, indicated generally at 10 is a schematic diagram illustrating electronic gaming machines (EGMs), like EGMs 12, 14, interconnected by a computer network. In the present embodiment, the EGM comprises a slot machine although it is understood that the invention can be used with other type of gaming devices such as video poker machines. Included in the network are three banks, indicated generally at 16, 18, 20, of EGMs. Each EGM is connected via a network connection, like connection 22, to a bank controller 24. In the present embodiment of the invention, each bank controller comprises a processor that facilitates data communication between the EGMs in its associated bank and the other components on the network. The bank controller also includes a CD ROM drive for transmitting digitized sound effects, such as music and the like, to a speaker 26 responsive to commands issued over the network to bank controller 24. The bank controller is also connected to an electronic sign 28 that displays information, such as jackpot amounts and the like, visible to players of machines on bank 16. Such displays are generated and changed responsive to commands issued over the network to bank controller 24. Each of the other banks 18, 20 of EGMs include associated bank controllers, speakers, and signs as shown, which operate in substantially the same manner.

Ethernet hub 30 connects each of the bank controllers associated with banks 16, 18, 20 of EGMs to a concentrator 32. Another Ethernet hub 34 connects similar bank controllers (not shown), each associated with an additional bank of EGMs (also not shown), to concentrator 32. The concentrator functions as a data control switch to route data from each of the banks to a translator 36. The translator comprises a compatibility buffer between the concentrator and a proprietary accounting system 38. It functions to place all the data gathered from each of the bank controllers into a format compatible with accounting system 38. In the present embodiment of the invention, translator 38 comprises a microprocessor, such as an Intel Pentium III 600 MHz processor, operating Microsoft Windows NT 4.0.

Another Ethernet hub 39 is connected to a configuration workstation 40, a player server 42, and to bonus servers 44, 46. Hub 39 facilitates data flow to or from workstation 40 and servers 42, 44, 46.

The configuration workstation 40 comprises a user interface. It comprises a personal computer including a keyboard, Intel Pentium or like processor and Ethernet card.

The player server 42 comprises a microcomputer that is used to control messages that appear on displays associated with each EGM. Player server 42 includes an Intel Pentium or like processor and an Ethernet card. Player activity and loyalty criteria (points) can be awarded and maintained on the player server and transmitted to the appropriate EGM 12 for display to the player as described in more detail below.

Bonus servers 44, 46 each comprise a microcomputer used to control bonus applications on the network. Each bonus application comprises a set of rules for awarding jackpots in excess of those established by the pay tables on each EGM. For example, some bonus awards may be made randomly, while others may be made to link to groups of EGMs operating in a progressive jackpot mode. Examples of bonuses that can be implemented on the network are disclosed in co-pending application Ser. No. 08/843,411, filed Apr. 15, 1997 and assigned to the Assignee of the present application (the '411 application), which is incorporated herein by reference for all purposes. This co-pending application also describes in more detail features of the network, like that shown in FIG. 1, which may be used to implement the present invention. Also incorporated herein by reference for all purposes is U.S. Pat. No. 5,655,961, assigned to the Assignee of the present application (the '961 patent), which also discloses bonuses that can be implemented by bonus servers 44, 46 and a network that could be used to implement the present invention.

Figure 2A:
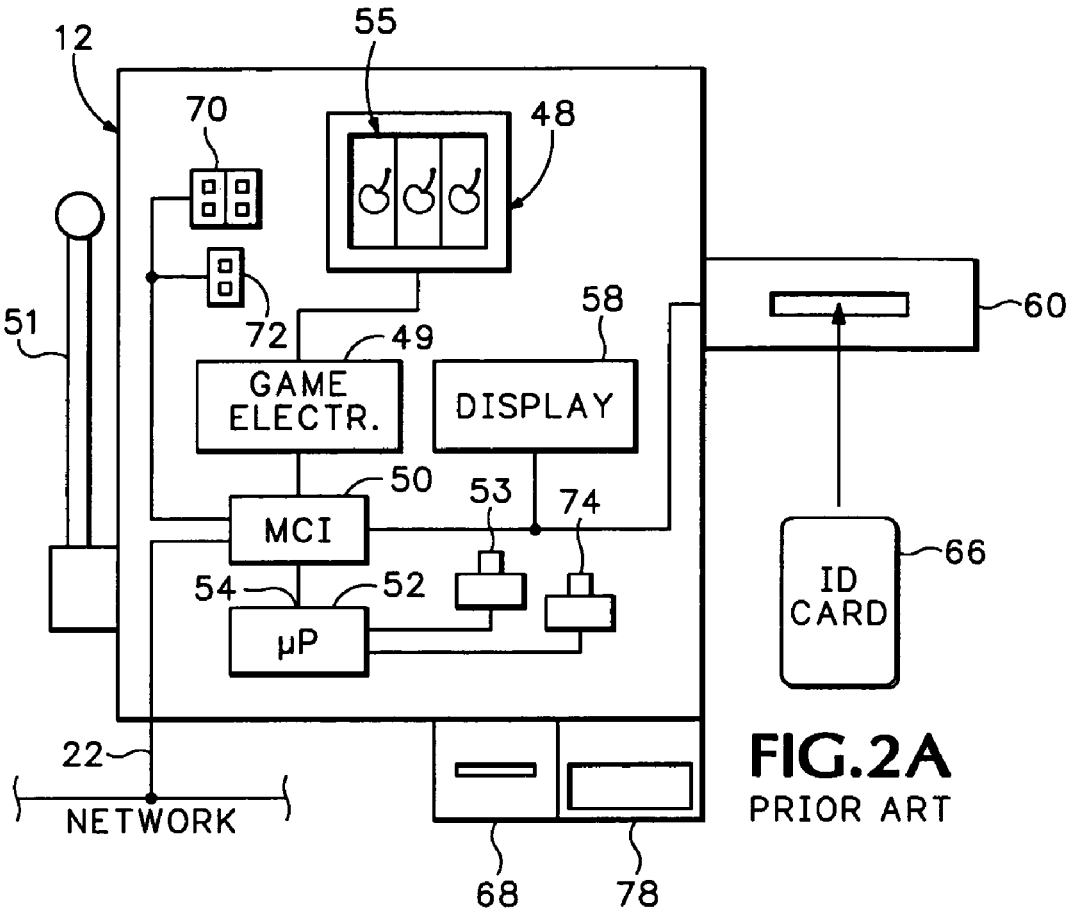
FIG.2A PRIOR ART
FIGS. 2A and 2B illustrate a schematic diagram and block diagram, respectively, of an electronic gaming machine with included player tracking display system and associated hardware implemented in accordance with the prior art.

FIG. 2A is a highly schematic representation of an electronic slot machine, which is typical of each of the machines in the network, constructed with a conventional player tracking display system and which incorporates network communications hardware as described hereinafter. This hardware is described in the '961 patent, and is referred to therein as a data communications node. Preferably the network communications hardware is like that disclosed in the '411 application, namely a machine communication interface (MCI) 50. MCI 50 facilitates communication between the network, via connection 22, and microprocessor 52, which controls the operation of EGM 12. This communication occurs via a serial port 54 on the microprocessor to which MCI 50 is connected.

Included in EGM 12 is a display 48 such as a CRT, LCD or the like. Gaming electronics 49, including a video driver card, creates and projects the game image onto display 48. The game image shown is that of three virtual reels that are displayed in a game display field 55 of display 48. Each virtual reel includes a plurality of different symbols thereon. In response to a pull on handle 51 or actuation of a spin button 53 after a wager is made, the symbols displayed on the reels change according to an algorithm stored in the gaming electronics to simulate the spinning of a mechanical reel system from more traditional slot machines.

MCI 50 may include a random access memory (RAM), which can be used as later described herein. The MCI also facilitates communication between the network and a vacuum florescent display (VFD) 58, and a card reader 60. Supplemental display 58 typically displays player tracking information or promotional messages received from the network or stored on the MCI.

Description will first be made of typical play on a slot machine, like EGM 12. A player plays EGM 12 by placing a wager and then pulling handle 51 or depressing spin button 53. The wager may be placed by inserting a bill into a bill acceptor 68. A typical slot machine, like EGM 12, includes a coin acceptor (not shown) that may also be used by the player to make a wager. A credit meter 70 is a numeric display that indicates the total number of credits available for the player to wager. The credits are in the base denomination of the machine. For example, in a nickel slot machine, when a five dollar bill is inserted into bill acceptor 68, a credit of 100 appears on credit meter 70. To place a wager, the player depresses a coin-in button (not shown), which transfers a credit from the credit meter 70 to a coin-in meter 72. Each time the button is depressed, a single credit transfers to the coin-in meter up to a maximum bet that can be placed on a single play of the machine. Alternatively, a maximum-bet button (also not shown) is provided to immediately transfer the maximum number of credits that can be wagered on a single play from the credit meter 70 to the coin-in meter 72.

When coin-in meter 72 reflects the number of credits that the player intends to wager, the player depresses spin button 53 thereby initiating a game.

The player may choose to have any jackpot won applied to credit meter 70. When the player wishes to cash out, the player depresses a cash-out button 74, which causes the credits on meter 70 to be paid in coins to the player at a hopper 78, which is part of machine 12. The machine consequently pays to the player, via hopper 78, the number of coins—in the base denomination of the machine—that appear on credit meter 70.

Typical slot machines, like machine 12, are limited in the total amount of coins that can be paid to the player from the hopper. Thus, when jackpots are in excess of the hopper-pay limit, the machine locks up and the jackpot is hand paid by casino personnel to the player. After the jackpot is so paid, the casino personnel resets the machine to permit play to resume.

Card reader 60 reads a player-tracking card 66 that is issued by the casino to individual players who choose to have such a card. Card reader 60 and player-tracking card 66 are known in the art, as are player-tracking systems, examples being disclosed in the '961 patent and '411 application. Briefly summarizing such a system, a player registers with the casino prior to commencing gaming. The casino issues a unique player-tracking card to the player and opens a corresponding player account that is stored on accounting system 38 (in FIG. 1). The account includes the player's name and mailing address and perhaps other information of interest to the casino in connection with marketing efforts. Prior to playing one of the EGMs in FIG. 1, the player inserts card 66 into reader 60 thus permitting accounting system 38 to track player activity, such as amounts wagered and won and rate of play.

When the casino opens a player account, it may implement a player tracking system that accounts for loyalty bonus points earned by the casino patron by frequent play.

The player selects one of the network slot machines—in this case machine 12—and inserts card 66 into reader 60. The player then inserts one or more bills into bill acceptor 68, which purchases a corresponding number of credits in the base denomination of the machine that are applied to and appear on credit meter 70. The player may also, of course, apply credits to the credit meter by depositing coin in the coin acceptor (not shown) that is part of machine 12. When the player inserts card 66 into reader 60, the player record that the casino created on accounting system 38 is fetched from the accounting system and loaded into memory in MCI 50. Insertion of card 66 into card reader 60 is referred to herein as a first command or a log-in command.

After the credits are displayed on meter 70, the player plays slot machine 12 in a conventional manner as described above. That is, the coin-in button (not shown) is depressed by the player to transfer the desired number of credits from credit meter 70 to coin-in meter 72. After so doing, the player presses spin button 53 to spin reels 48. Upon completion of the game, i.e., after the reels stop "spinning", any jackpot payable according to a pay table internal to machine 12 is also applied to credit meter 70. Similarly, any bonuses, i.e., any payments to the player that result from awards not generated by the pay table in machine 12, as described in the '961 patent, are also applied to credit meter 70.

Figure 2B:
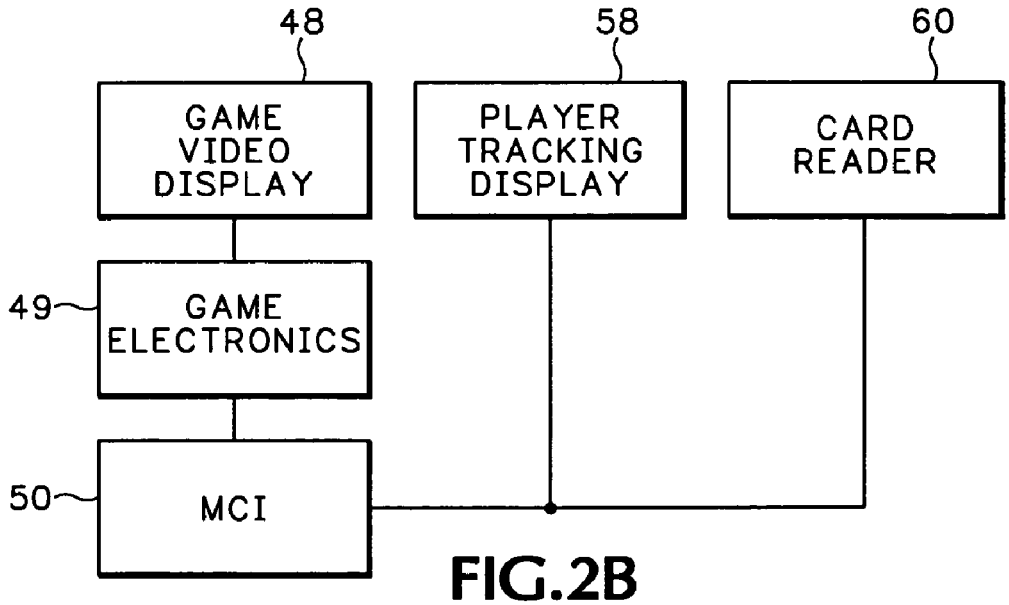
FIG.2B PRIOR ART

FIG. 2B illustrates a block diagram of the main components operating within the prior art gaming machine player tracking display system. The game elements of concern here are the video display 48 and the game electronics 49. The game electronics monitors player actions—coins and currency in, game buttons pressed, etc., creates the game image, determines game results and issues credits when wins occur. Game statistics and other information are sent, usually via serial port, to a separate player tracking system electronics, represented here the Data Collection Node or MCI 50. The MCI is connected to an external network 22 from which it obtains information about how points are earned as well as information about individual players which are identified when the player inserts a card into the card reader 60.

Some player tracking systems also send information back to the game electronics—most often these are commands telling the game to pay a bonus by assigning additional credits to the game or to pay jackpots at some multiple of their normal value. Sending such information back to the game electronics is generally referred to as bi-directional communication or bonus events. This sort of connectivity has become so important that several standards have evolved defining exactly how such events are communicated. An industry group, GAMMA—(GAming Machine Manufacturers), has even been created to establish and maintain such standards. While FIG. 2B represents the standard industry method of today, it suffers from the limitations that a separate player tracking display 58 is required to display the player loyalty points or other information no generated directly by the gaming electronics 49.

Figure 3:
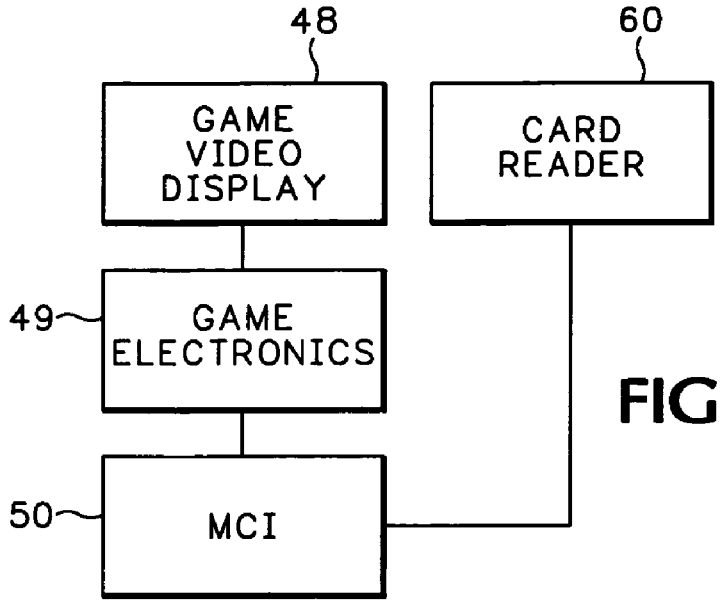
FIG. 3 is a block diagram showing a player tracking display system implemented according to a first embodiment of the invention.

FIG. 3 illustrates a block diagram of a first implementation of the invention adapted to overcome the drawbacks of prior art player tracking display systems. Here, the player tracking display is removed. Player-specific information is then routed directly to the game video display by expanding the information exchanged between the MCI 50 and game electronics 49. No additional serial port is required. Only additional commands must be—defined—and such definition is the exact purpose of industry associations like GAMMA. In addition, the Game Electronics must be reconfigured to place the player-specific information on a chosen area of the screen. The Game Electronics can be further modified to present this information as animated graphics where appropriate.

In some cases it may not be possible to modify the game electronics 49 either because there is simply no capacity to carry out the additional display functions or because the game manufacturer chooses not to make hardware or software modifications.

Figure 4A:
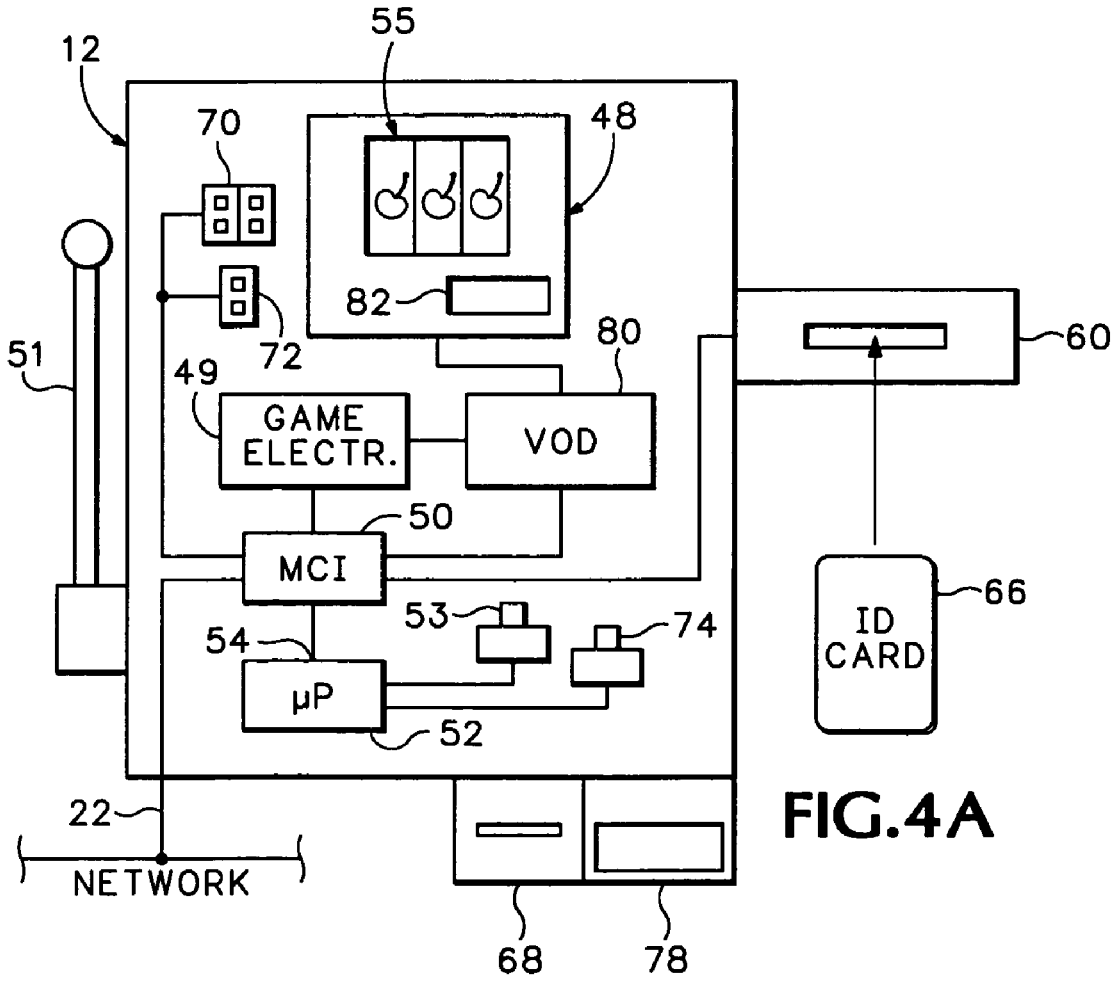
FIGS. 4A-4C illustrate a schematic diagram, block diagram, and schematic screen display, respectively, of a preferred implementation of a player tracking display system installed in an electronic gaining machine according to the present invention.
Figure 4B:
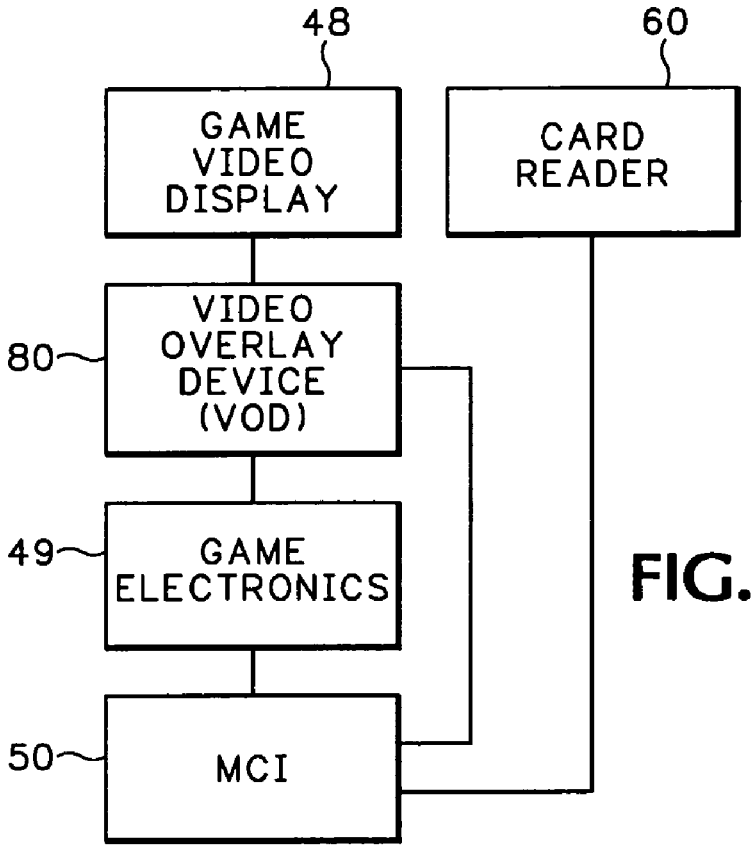
Figure 4C:
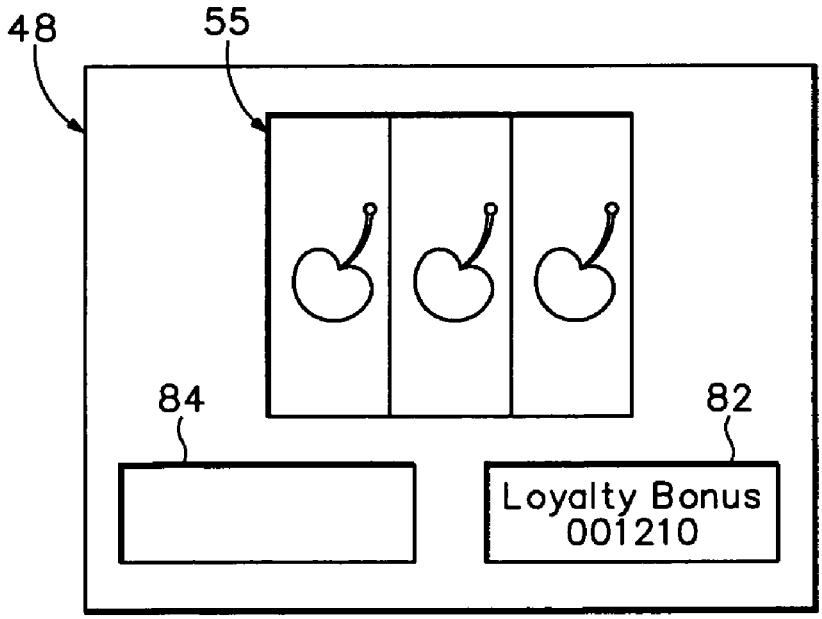

FIGS. 4A, 4B and 4C illustrate a preferred apparatus employing a method that is useful in such situations. A Video Overlay Device (VOD) 80 is inserted between the game electronics 49 and the video display 48. Under normal circumstances the VOD 80 simply passes video signals from game electronics, unmodified, to the video display 48. Since most modern video displays are raster-scan devices (i.e. CRT-based monitors), a description will now be given corresponding to the operation of the VOD 80 in these type of raster scan devices. It is understood, however, that video overlay can be performed digitally as well in non-raster-based display devices.

In the raster-scan display device, the interface between the video display and game electronics carries synchronization signals from the video display for both Horizontal (HSYNC) and Vertical (VSYNC) positions. These HSYNC and VSYNC signals determine where on the screen an image is located. An image is painted onto the screen as horizontal lines beginning in the top left corner. As the line is traced from left to right, three electron beams of varying colors (red, green and blue) are focussed on the viewing screen's phosphor coatings. Each beam is varied from low to high in intensity depending upon the image being show. Low intensity causes the color that beam represents to be dim or totally invisible. A high intensity beam creates a bright representation for that color. By varying the intensity of each beam at a particular time, virtually any color can be displayed. All beams on in the same intensity create a white color. All beams off gives the perception of black.

At the end of each trace an HSYNC pulse is generated and the next line of video is projected some distance below the first. Any number of lines may be represented, according to the type of video monitor being used. Older displays typically provided 200 vertical lines. Newer displays allow 480, 600, 768 or 1,024 lines. When the last line is completed, a VSYNC pulse is generated to indicate a new screen of video information is to begin. Most video displays generate from 50 to 100 complete displays of information each second.

In the time between HSYNC pulses, the beam is moving from left to right across the screen. The location of the beam at any time is closely correlated by the amount of time passed since the HSYNC pulse appeared. By counting the HSYNC pulses since the last VSYNC pulse, a precise vertical location of the beam can also be determined.

The VOD counts HSYNC pulses and resets this counter after each VSYNC, while simultaneously passing both signals on to the game electronics which uses the same scheme to determine what portion of the normal game image to present. It also contains a precision timer that is reset after each HSYNC pulse. The VOD 80 is configured to exactly pass through the game electronics video signal to the video display 48 in most areas.

But the VOD 80 also contains video information of its own. It is programmed to substitute this video information for the game electronics 49 information at specific screen locations. This allows the VOD to present blocks of its own video images at any screen location desired. This block would appear to the player to be a part of the game display. By choosing areas of the screen that are unimportant to game play, the VOD can project any desired information and have it appear as if that information is embedded within the game display. The game electronics need never know that the VOD exists. The game electronics continues to function as if it has full control of the video display and therefore requires no modification.

An interface, generally consisting of a serial port and some discrete control lines for fast signaling connects the VOD to the MCI 50. This allows the MCI to send coordinates on the video blocks to display, turn the blocks on and off and even display alphanumeric characters that spell the player's name or point balances as identified by the player's account information. The latter is possible because the VOD includes a character generator circuit which is now readily available in inexpensive, standard video integrated circuits which are well know to any computer hardware engineer.

FIG. 4C illustrates the arrangement of content on the gaming machine display screen 48. The gaming electronics 49 operates to display an image within a game display field 55 of the display 48. The image shown in FIG. 4C corresponds to a reel-based game. It is understood, however, that other types of games can be created within the game display filed such as poker (five cards) or the like. Other information can be overlaid by the VOD 80 on portions of the general gaming display 48 that would not substantially interfere with the enjoyment and operation of the game displayed within display field 55, such as within player tracking display field 82 and added graphics field 84. Types of information that can be displayed within display field 55 include, but are not limited to, player name, player ID, player point total, session point total, personal progressive, number of extra credits, information about a bonus related to card use (loyalty bonus), and the loyalty award. The loyalty award can be linked to a player's response time.

The preferred embodiment has the advantage of allowing one to easily retrofit existing gaming machines to allow a single color display screen to display important information to the player without interfering with game play. The more general embodiment shown in FIG. 3, however, would not require additional electronics in each of the gaming machines but would require that the firmware programming by altered.

Having described and illustrated the principles of the invention in a preferred embodiment thereof, it should be apparent that the invention can be modified in arrangement and detail without departing from such principles. I claim all modifications and variation coming within the spirit and scope of the following claims.

I claim:

1. A gaming machine simultaneously displaying player tracking information and a game image to a player on the same display when the gaming machine is in communication with a host computer over a network, and the host computer maintains a player tracking account with player tracking information associated with a player, the gaming machine comprising:

a player tracking input device receiving player identification information;

a communications interface providing the received player identification information to the host computer;

a display;

game electronics providing a game image, the game image including display fields, the display fields including a game display field including game output information;

a video overlay device apart from the game electronics, the video overlay device coupled between the game electronics and the display to receive the game image and receive, responsive to the host computer identifying the player based on the player identification information, the player tracking information from the player account at the host computer via the communications interface, generate a player tracking information image including the player tracking information, determine one or more regions of the game image that are not occupied by a display field, including the game display field, wherein the one or more regions are portions of the game image that if overlaid would not overlay a display field, overlay the player tracking information image on the determined one or more regions of the game image, thereby creating a combined image, and wherein the player tracking information image appears to be embedded within the game image, provide the combined image to the display, and provide, when the player is not identified, only the game image to the display.

2. The gaming machine of claim 1, wherein the player tracking information image includes an animated graphic.

3. The gaming machine of claim 1, wherein the game image shows a plurality of reels in the game display field.

4. The gaming machine of claim 1, wherein the player tracking input device includes a card reader.

5. The gaming machine of claim 1, wherein the player tracking information image includes one or more items selected from the group consisting of a player name, player ID, point data, progressive data, extra credit data, bonus data, loyalty data, and award data.

6. A gaming machine simultaneously displaying player tracking information and a game image to a player on the same display when the gaming machine is in communication with a host computer over a network, and the host computer maintains a player tracking account with player tracking information associated with a player, the gaming machine comprising:

a card reader receiving player identification information from a player tracking card;

a communications interface providing the received player identification information to the host computer;

a game video display;

game electronics providing a game image having a plurality of display fields, including a game display field containing game output information;

a video overlay device apart from the game electronics, the video overlay device coupled between the game electronics and the game video display to receive the game image and receive, responsive to the host computer identifying the player based on the player identification information, the player tracking information from the player account at the host computer via the communications interface, generate a player tracking information image including the player tracking information, determine one or more regions of the game image that are not occupied by a display field, including the game display field, wherein the one or more regions are portions of the game image that if overlaid would not overlay a display field, overlay the player tracking information image on the determined one or more regions of the game image, thereby creating a combined image, and wherein the player tracking information image appears to be embedded within the game image, provide the combined image to the game video display, and provide, when the player is not identified, only the game image to the game video display.

7. The gaming machine of claim 6, wherein the player tracking information image includes an animated graphic.

8. The gaming machine of claim 6, wherein the game image shows a plurality of reels in the game display field.

9. The gaming machine of claim 6, wherein the player tracking information image includes one or more items selected from the group consisting of a player name, player ID, point data, progressive data, extra credit data, bonus data, loyalty data, and award data.

10. A method of simultaneously displaying player tracking information and a game image to a player on the same display of a gaming machine in communication with a host computer over a network, the host computer maintaining a player tracking account with player tracking information associated with a player, the method comprising:

providing, in game electronics coupled to a video overlay device, a game image having display fields including a game display field containing game output information;

receiving, in the video overlay device coupled between the game electronics and the display, the game image, the video overlay device being apart from the game electronics;

receiving player identification information;

determining whether the host computer identifies the player based on the player identification information;

when the host computer identifies the player:

receiving the player tracking information from the player account at the host computer via the communications interface, generating a player tracking information image including the player tracking information at the video overlay device, determining at the video overlay device one or more regions of the game image that are not occupied by a display field, including the game display field, wherein the one or more regions are portions of the game image that if overlaid would not overlay a display field, combining, in the video overlay device, the player tracking information image with the game image to define a combined image by overlaying the player tracking information image on the one or more regions of the determined one or more regions of the game image, and wherein the player tracking information image appears to be embedded within the game image, and providing the combined image to the display; and when the host computer does not identify the player:

providing, from the video overlay device, only the game image to the display.

11. The method of claim 10, wherein the player tracking information image includes an animated graphic.

12. The method of claim 10, wherein the game image shows a plurality of reels in the game display field.

13. The gaming machine of claim 10, wherein the player tracking information image includes one or more items selected from the group consisting of a player name, player ID, point data, progressive data, extra credit data, bonus data, loyalty data, and award data.

* * * * *